5/7/85 XP 4,514,947

United States Patent [19]

Grail

[11] Patent Number: 4,514,947

[45] Date of Patent: May 7, 1985

[54] ROOF TILE AND TILE COMPOSITION OF MATTER

[75] Inventor: Donald J. Grail, Santa Ana, Calif.

[73] Assignee: Embelton-Grail, Inc., Sherman Oaks, Calif.

[21] Appl. No.: 495,829

[22] Filed: May 18, 1983

[51] Int. Cl.[3] ..... E04D 1/00

[52] U.S. Cl. ..... 52/536; 52/533; 52/560; 52/602; 106/90; 524/5

[58] Field of Search ..... 52/533, 536, 560, 518, 52/602

[56] References Cited

U.S. PATENT DOCUMENTS

| | | | |
|---|---|---|---|
| 816,252 | 3/1906 | Price | 52/533 |
| 881,700 | 3/1908 | Miller | 52/602 |
| 1,124,001 | 1/1915 | Elzey | 52/533 |
| 4,279,106 | 7/1981 | Gleason | 52/536 |

FOREIGN PATENT DOCUMENTS

| | | | |
|---|---|---|---|
| 1708994 | 1/1979 | Fed. Rep. of Germany | 52/536 |

*Primary Examiner*—Henry E. Raduazo
*Attorney, Agent, or Firm*—John Joseph Hall

[57] ABSTRACT

A roof tile made of a composition of matter comprising cement, silica sand, iron oxide pigment, acrylic polymer resin, an antifoaming agent and water, and formed into a shape having a top surface, a bottom surface, a top end, a butt end, and with a longitudinal side edge having a longitudinal flange, and another longitudinal side edge having a longitudinal concavity, with a plurality of ribs formed in the bottom surface, and reinforcing wire embedded in said ribs and the bottom perimeter of the tile.

5 Claims, 10 Drawing Figures

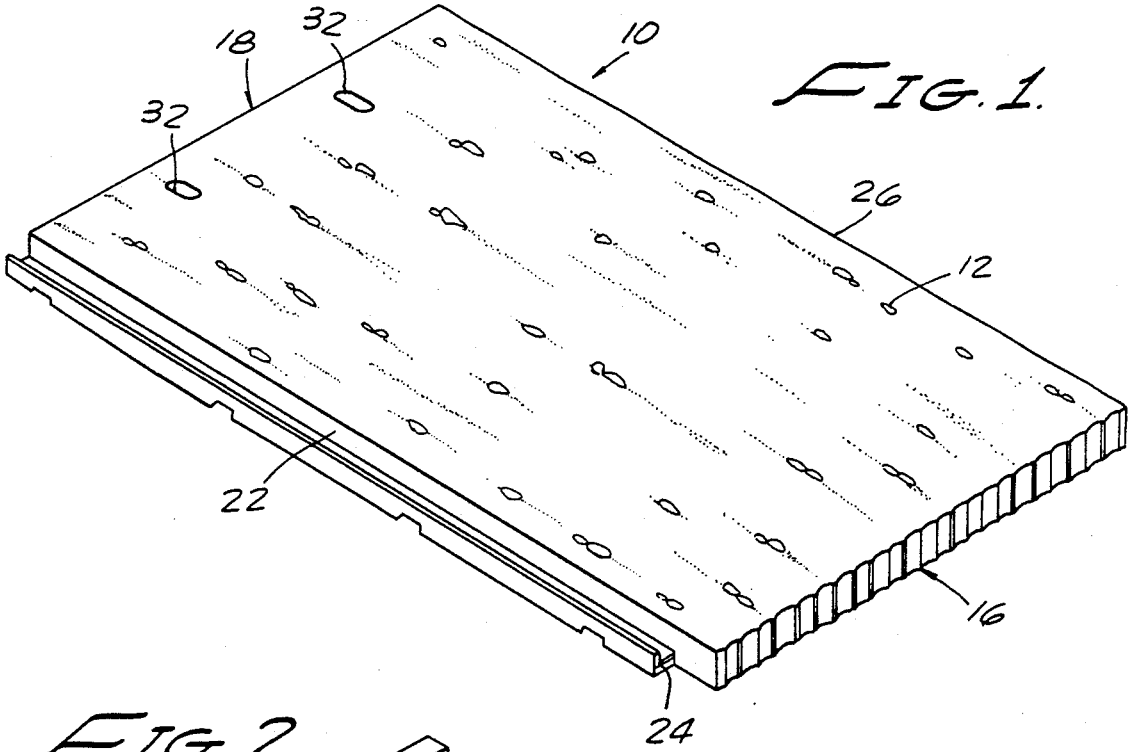
FIG. 1.
FIG. 2.
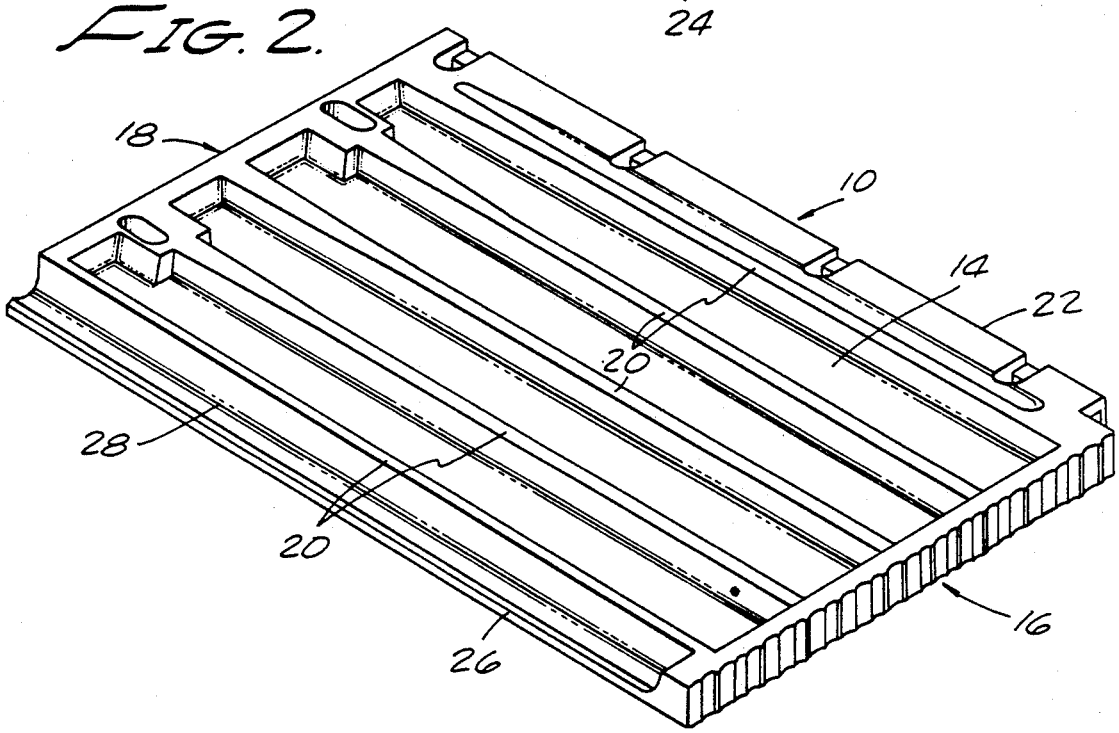
FIG. 3.
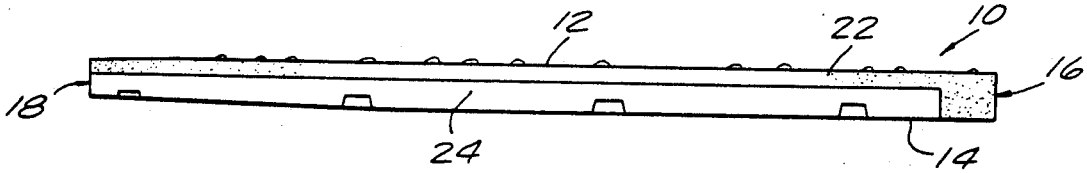

FIG. 4.
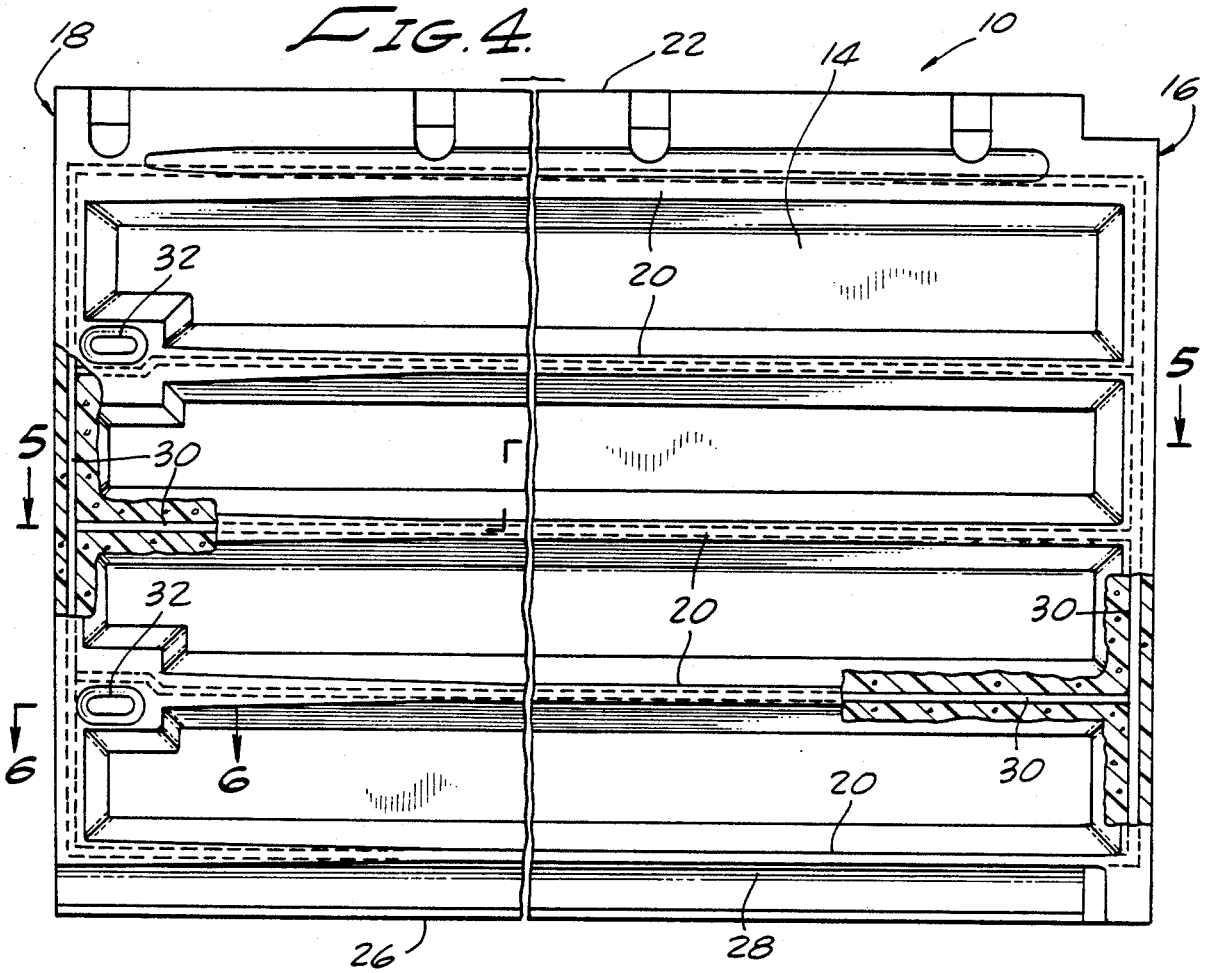
FIG. 5.
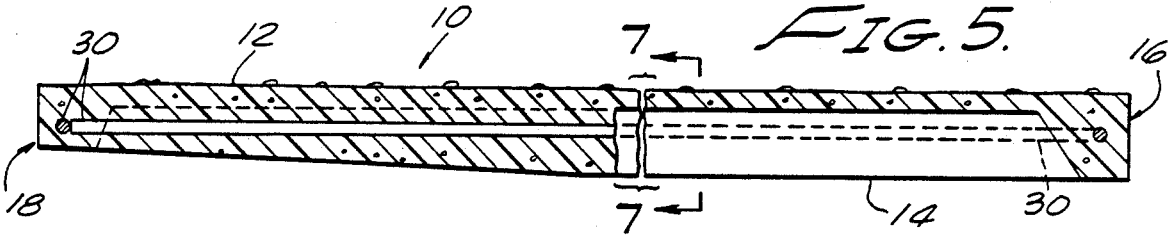
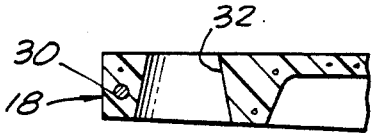
FIG. 6.
FIG. 7.
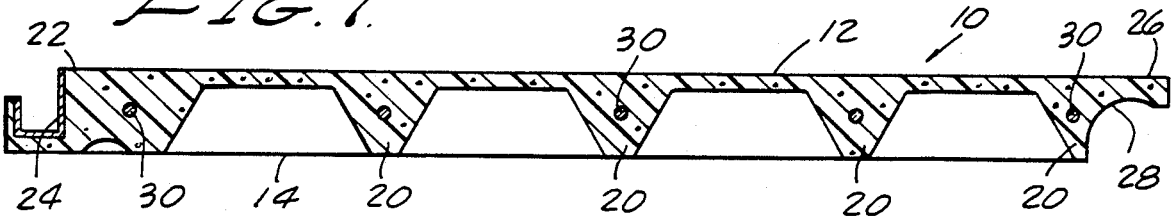

ROOF TILE AND TILE COMPOSITION OF MATTER

BACKGROUND OF THE INVENTION

Conventional tile roofing materials, including those made from cement or clay, weigh approximately 1,000 pounds per square (100 square feet) and thus require buildings to have considerably greater structural strength to accommodate their weight. Examples of such conventional roofing materials are shown in U.S. Pat. Nos. 4,251,527; 4,010,232; 4,191,722; 3,025,772; 3,330,080; 3,897,667; 3,760,546; and 4,178,727.

Normally, there is a direct correlation between the structural strength requirement of a building and the cost of the building, such that the greater the structural strength, the greater the cost.

The present invention provides a roof tile having a weight of approximately 430 pounds per square, less than one-half of conventional roofing materials, so that structural requirements of a building can be kept to a minimum, thereby eliminating substantial cost required for conventional heavy roof material.

Due to numerous fires in recent years, many municipalities have passed stringent fire safety laws requiring fire retardant roofing materials for new construction as well as for repairs and replacement of roofs of buildings. Under these laws, a great number of existing structures, particularly those having wood shake roofs, would require reinforcement of their roof trusses, as well as walls and foundations to accommodate a conventional cement or clay tile roof. The use of the present invention would eliminate such reinforcement otherwise required, and the attendant cost.

Further, conventional cement and clay tiles are subject to water absorption which renders them susceptible to cracking upon exposure to a freezing environment. The roof tile of the present invention has a limited water absorption of only about 5% water by weight, so that freeze-thaw cycling of the environment will not produce any cracking of the tile.

Moreover, conventional cement and clay roofing materials are often brittle and break when walked upon. The roof tile of the present invention is provided with reinforcing ribs and additional reinforcement throughout by the embedding of reinforcing wire in the ribs and perimeter of the tile, so that normal walking on the tile will not damage it.

SUMMARY OF THE INVENTION

The roof tile of the present invention is provided with a plurality of spaced longitudinal ribs at its lower surface which run the full length of the tile for strength. One longitudinal edge of the roof tile is provided with a flange and the other longitudinal edge is provided with a longitudinal concavity. Together with the longitudinal flange of a neighboring tile, the concavity provides a water drain when the tiles are placed on the roof.

The roof tile is provided with a reinforcing wire preferably welded together and embedded within each of the ribs and throughout the perimeter of the roof tile. Openings in the roof tile receive nails or other securing means to maintain the roof tile in position on the roof.

The roof tile is made up of a composition of matter including cement and silica aggregates, modified by an acrylic polymer, with an anti-foaming agent and water.

The acrylic resin enhances tensile and compressive strength, flexibility, abrasion and impact strength, as well as resistance to moisture and mold. The reinforcing wire enhances flexibility when weight is placed on the tile by a person walking on it.

It is, therefore, an object of my invention to provide a cement type roof tile which is fire proof and yet only about one-half the weight of conventional cement and clay roofing materials.

Another object of my invention is to provide a roof tile which has only limited absorption of water and will not crack under cycles of freezing and thawing weather.

A further object of my invention is to provide a roof tile which is not brittle and is relatively flexible to allow weight placed on it by normal walking of a person without damage to the tile.

A yet further object of my invention is to provide a relatively light weight cement type roof tile with enhanced tensile and compression strength, along with flexibility and abrasion and impact strength.

These and other objects will be more readily understood by reference to the following description and claims, taken in conjunction with the accompanying drawings, in which FIG. 1 is a perspective view of the top surface of an embodiment of the invention;

FIG. 2 is a perspective view illustrating the lower surface of an embodiment of the invention and the ribs thereof;

FIG. 3 is a side elevational view showing the tapered end of an embodiment of the invention;

FIG. 4 is a bottom view illustrating the rib section of an embodiment of the invention with a broken portion showing the reinforcing wire;

FIG. 5 is a view taken on line 5—5 of FIG. 4;

FIG. 6 is a view taken on line 6—6 of FIG. 4;

FIG. 7 is a view taken on line 7—7 of FIG. 5;

Figure 8:
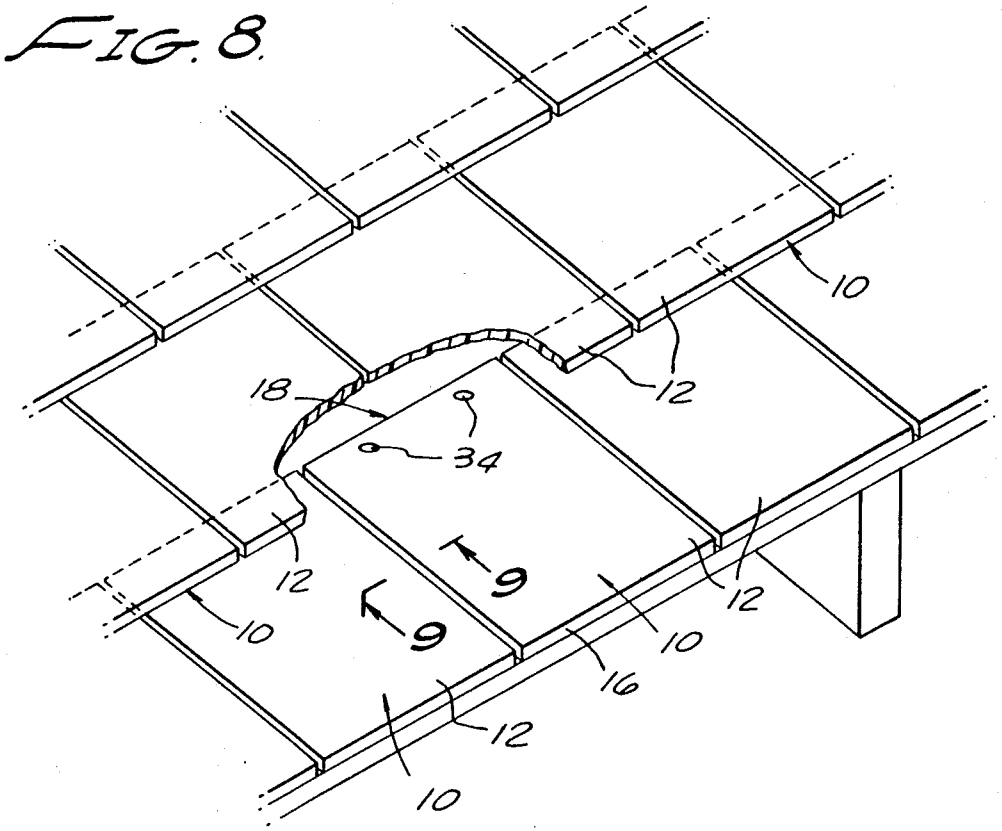
FIG. 8 is a perspective view of an arrangement of a plurality of embodiments of the invention in position on a roof.
Figure 9:
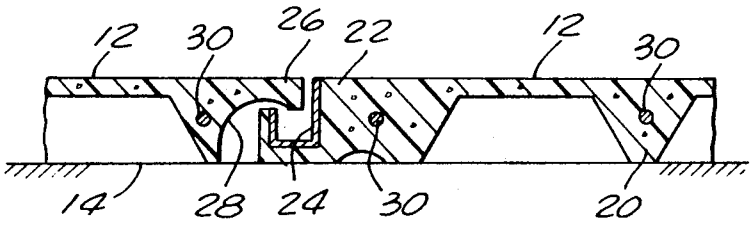
FIG. 9 is a view taken on line 9—9 of FIG. 8.
Figure 10:
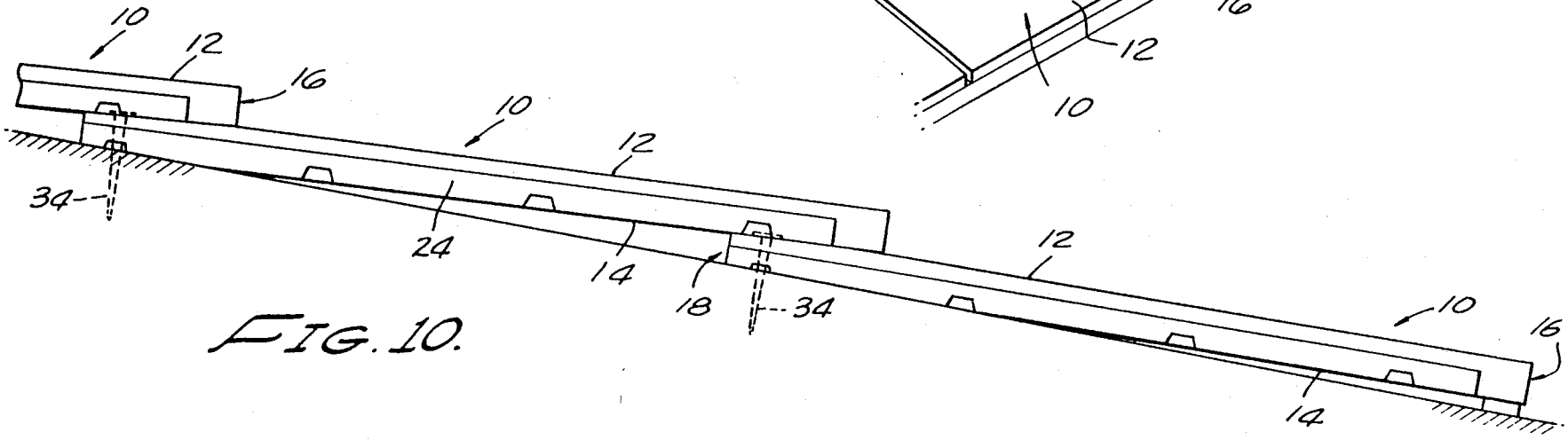
FIG. 10 is a side view of the invention showing the overlapping arrangement of the tiles on a roof.

The roof tile 10 has a top surface 12 and a bottom surface 14 which are both tapered toward each other from the butt end 16 of the roof tile 10 toward the top end 18 of roof tile 10. The top surface 12 is preferably textured.

The bottom surface 14 is provided with a plurality of spaced longitudinal ribs 20, preferably 5 in number, which run the full length of the roof tile 10.

One longitudinal edge 22 of the roof tile 10 is provided with a longitudinal flange 24, and the other longitudinal edge 26 is formed with a longitudinal concavity 28 which provides a water drain in conjunction with the flange 24 of a neighboring roof tile.

A reinforcing wire 30, preferably 14 gauge steel, is embedded throughout the perimeter and within each of the ribs 20 of the roof tile 10 at its bottom. For greater strength, wire 30 may be welded together throughout.

The roof tile 10 is provided with openings 32 which receive nails 34 or other suitable securing means to secure the roof tile 10 to the roof of a house.

The roof tile 10 is formed by pouring a predetermined mixture of aggregate, cement, pigment, and plastic polymers, into a mold. The plastic polymer is preferably an acrylic polymer.

A general example of the formulation of the composition of matter making up the roof tile, is as follows:

EXAMPLE 1

| Ingredient | Pounds |
|---|---|
| Cement | 30 |
| Silica Sand | 70 |
| Pigment | 1 |
| Acrylic Polymer Resin | 9 |
| Antifoaming Agents | 0.1 |
| Water | 8 |

The above amounts may be varied as to each ingredient plus or minus 10% without adversely affecting the results obtained by the invention.

A preferred embodiment of a composition of matter making up the roof tile is illustrated in the following Example 2:

EXAMPLE 2

| Ingredient | Pounds |
|---|---|
| Portland Cement | 30 |
| Silica Sand #30 Mesh | 47 |
| Silica Sand #90 Mesh | 23 |
| Iron Oxide Pigment | 1 |
| Acrylic Polymer Resin, Rhoplex MC-76 | 9 |
| Water | 8 |
| Antifoaming Agent Nopco NXZ | 0.1 |

The acrylic polymer used in this composition of matter is known as Rhoplex MC-76 and is manufactured by Rohm and Haas Company, Philadelphia, Pennsylvania. The acrylic polymer known as Rhoplex MC-76 has the appearance of a white, milky liquid, a solids content of 46–48°, a pH of 9.5 to 10, a specific gravity of 1.059, and has a freeze-thaw stability of 5 cycles, a minimum film form temperature of 10° to 12° centigrade, and weighs 8.8 pounds per gallon.

The Portland Cement used may be Type I or Type II. The iron oxide is preferably synthetic iron oxide which is micronized, and the ratio of iron oxide to the cement in the composition of matter should be 3° by weight of pigment to 100% by weight of cement.

The antifoaming agent sold under the trade NOPCO NXZ, produced by Diamond Shamrock, has a description of an emulsifiable paraffin oil with not over 1% silicone contained therein.

The composition of matter making up the roof tile is prepared in a paddle type mixer, beginning with the addition of the acrylic polymer and the antifoaming agent to ½ of the water.

Thereafter, the cement, pigment, and silica sand are added to the mixture in the above order, and then the remaining ½ of the water is added. The resulting mixture is stirred and mixed for about 3 to 4 minutes, and then is poured into a suitable mold, which has been previously provided with reinforcing wire 30 in the ribbed areas and perimeter of the tile. The mold also has provision for providing the openings 32 of the roof tile 10.

To produce a preferred embodiment of the roof tile 10, about 3 pounds, twelve ounces of the tile mixture is pured into a mold and vibrated slightly. The filled mold is then placed in a cure room for about 24 hours with a temperature of 100° F. and with the air being circulated to remove moisture in the air.

The roof tile 10 is then removed from the mold and from the cure room.

Preferably, the roof tile 10 is then sprayed on its top surface with a cement mixture to produce a texture over the top surface.

The textured roof tile 10 is then returned to the cure room overnight, about 12 hours, and is then ready for shipment. The finished tile weights about 4 pounds.

Although I have described preferred embodiments of my invention, it is understood that the scope of the invention is not limited thereby, but numerous variations in ingredients and structure are possible without departing from the spirit and scope of the invention as claimed hereinafter.

I claim:

1. A roof tile comprising:

a top surface, a bottom surface, a top end, a butt end, said top and bottom surfaces being tapered towards each other from said butt end to said top end, said roof tile being provided with one longitudinal side edge having a longitudinal flange, and another longitudinal edge having a longitudinal concavity;

a plurality of spaced longitudinal ribs each of equal width and depth formed in said bottom surface and extending continously from said butt end to said top end;

longitudinal reinforcing wire embedded in each of said ribs;

longitudinal reinforcing wire embedded in the bottom perimeter of said roof tile and in the same plane as said wire embedded in said ribs; and means for securing said tile to a roof.

2. A roof tile according to claim 1 in which the reinforcing wire is welded together throughout the tile.

3. A roof tile according to claim 1 in which the plurality of ribs is five in number.

4. A roof tile according to claim 1 in which the top surface is textured.

5. A roof tile according to claim 1 in which the means for securing the tile is a pair of openings in the tile to receive securing members.

* * * * *